US008219394B2

(12) United States Patent
Flaks et al.

(10) Patent No.: US 8,219,394 B2
(45) Date of Patent: Jul. 10, 2012

(54) ADAPTIVE AMBIENT SOUND SUPPRESSION AND SPEECH TRACKING

(75) Inventors: Jason Flaks, Redmond, WA (US); Ivan Tashev, Kirkland, WA (US); Duncan McKay, Woodinville, WA (US); Xudong Ni, Woodinville, WA (US); Robert Heitkamp, Sammamish, WA (US); Wei Guo, Sammamish, WA (US); John Tardif, Sammamish, WA (US); Leo Shing, Redmond, WA (US); Michael Baseflug, Duvall, WA (US)

(73) Assignee: Microsoft Corporation, Redmond, WA (US)

( * ) Notice: Subject to any disclaimer, the term of this patent is extended or adjusted under 35 U.S.C. 154(b) by 403 days.

(21) Appl. No.: 12/690,827

(22) Filed: Jan. 20, 2010

(65) Prior Publication Data

US 2011/0178798 A1 Jul. 21, 2011

(51) Int. Cl.

| | |
|---|---|
| ***G10L 11/00*** | (2006.01) |
| ***G10L 21/02*** | (2006.01) |
| *G10L 21/00* | (2006.01) |

(52) U.S. Cl. ..... 704/227; 379/406.03; 381/302; 704/200; 704/231; 704/270

(58) Field of Classification Search ..... 704/200, 704/227; 381/302; 379/406.03
See application file for complete search history.

(56) References Cited

U.S. PATENT DOCUMENTS 4,658,426 A * 4/1987 Chabries et al. ..... 381/94.3
4,802,227 A 1/1989 Elko et al.
5,251,263 A * 10/1993 Andrea et al. ..... 381/71.6
5,544,250 A 8/1996 Urbanski
5,742,694 A * 4/1998 Eatwell ..... 381/94.2
5,924,061 A * 7/1999 Shoham ..... 704/218
6,691,092 B1 * 2/2004 Udaya Bhaskar et al. .... 704/265
6,970,796 B2 11/2005 Tashev
(Continued)

FOREIGN PATENT DOCUMENTS

WO 2008061534 A1 5/2008

OTHER PUBLICATIONS

Lefkimmiatis, et al., "A generalized estimation approach for linear and nonlinear microphone array post-filters", Retreived at<<http://cvsp.cs.ntua.gr/publications/jpubl+bchap/LefkimmiatisMaragos_GeneralizedEstimationMicrophoneArrays_specom2007.pdf>>, Feb. 4, 2007, pp. 10.

(Continued)

*Primary Examiner* — Justin Rider
(74) *Attorney, Agent, or Firm* — Alleman Hall McCoy Russell & Tuttle LLP

(57) ABSTRACT

A device for suppressing ambient sounds from speech received by a microphone array is provided. One embodiment of the device comprises a microphone array, a processor, an analog-to-digital converter, and memory comprising instructions stored therein that are executable by the processor. The instructions stored in the memory are configured to receive a plurality of digital sound signals, each digital sound signal based on an analog sound signal originating at the microphone array, receive a multi-channel speaker signal, generate a monophonic approximation signal of the multi-channel speaker signal, apply a linear acoustic echo canceller to suppress a first ambient sound portion of each digital sound signal, generate a combined directionally-adaptive sound signal from a combination of each digital sound signal by a combination of time-invariant and adaptive beamforming techniques, and apply one or more nonlinear noise suppression techniques to suppress a second ambient sound portion of the combined directionally-adaptive sound signal.

20 Claims, 4 Drawing Sheets

U.S. PATENT DOCUMENTS

| | | | | |
|---|---|---|---|---|
| 6,999,541 | B1 * | 2/2006 | Hui | 375/350 |
| 7,003,099 | B1 * | 2/2006 | Zhang et al. | 379/406.03 |
| 7,046,812 | B1 * | 5/2006 | Kochanski et al. | 381/92 |
| 7,203,323 | B2 | 4/2007 | Tashev | |
| 7,289,586 | B2 * | 10/2007 | Hui | 375/349 |
| 7,359,504 | B1 | 4/2008 | Reuss et al. | |
| 7,394,907 | B2 | 7/2008 | Tashev | |
| 7,415,117 | B2 | 8/2008 | Tashev et al. | |
| 7,426,464 | B2 * | 9/2008 | Hui et al. | 704/227 |
| 7,487,056 | B2 | 2/2009 | Tashev | |
| 7,533,015 | B2 * | 5/2009 | Takiguchi et al. | 704/205 |
| 7,813,499 | B2 * | 10/2010 | Chhetri et al. | 379/406.14 |
| 7,865,236 | B2 * | 1/2011 | Cory et al. | 600/547 |
| 7,953,596 | B2 * | 5/2011 | Pinto | 704/233 |
| 2005/0207583 | A1 * | 9/2005 | Christoph | 381/57 |
| 2005/0232441 | A1 | 10/2005 | Beaucoup et al. | |
| 2006/0015331 | A1 * | 1/2006 | Hui et al. | 704/227 |
| 2006/0072693 | A1 * | 4/2006 | Hui | 375/350 |
| 2006/0085049 | A1 * | 4/2006 | Cory et al. | 607/48 |
| 2006/0222172 | A1 | 10/2006 | Chhetri et al. | |
| 2008/0232607 | A1 | 9/2008 | Tashev et al. | |
| 2008/0243497 | A1 | 10/2008 | Tashev et al. | |
| 2008/0273713 | A1 * | 11/2008 | Hartung et al. | 381/86 |
| 2008/0273714 | A1 * | 11/2008 | Hartung | 381/86 |
| 2008/0273723 | A1 * | 11/2008 | Hartung et al. | 381/302 |
| 2008/0273724 | A1 * | 11/2008 | Hartung et al. | 381/302 |
| 2008/0273725 | A1 * | 11/2008 | Hartung et al. | 381/302 |
| 2008/0288219 | A1 | 11/2008 | Tashev et al. | |

OTHER PUBLICATIONS

Qi, et al., "Automotive 3-Microphone Noise Canceller in a Frequently Moving Noise Source Environment", Retreived at<<http://www.waset.org/journals/ijsp/v3/v3-4-40.pdf>>, 2007, pp. 298-304.

Reuven,et al., "Joint noise reduction and acoustic echo cancellation using the transfer-function generalized sidelobe canceller", Retreived at<<http://webee.technion.ac.il/Sites/People/IsraelCohen/Publications/SPECOM_2007b.pdf>>, Dec. 16, 2006, pp. 13.

Neo, et al., "Robust Microphone Arrays Using Subband Adaptive Filters", Retreived at <<http://citeseerx.ist.psu.edu/viewdoc/download?doi=10.1.1.5.3332&rep=rep1&type=pdf>>, May 2001, pp. 4.

Sullivan, et al., "Multi-Microphone Correlation-Based Processing for Robust Speech Recognition", Retrieved at <<http://citeseerx.ist.psu.edu/viewdoc/download?doi=10.1.1.66.4596&rep=rep1&type=pdf>>, Aug. 1996, pp. 4.

* cited by examiner

ADAPTIVE AMBIENT SOUND SUPPRESSION AND SPEECH TRACKING

BACKGROUND

Various computing devices, including but not limited to interactive entertainment devices such as video gaming systems, may be configured to accept speech inputs to allow a user to control system operation via voice commands. Such computing devices include one or more microphones input that enable the computing device to capture user speech during use. However, distinguishing user speech from ambient noise, such as noise from speaker outputs, other persons in the use environment, fixed sources such as computing device fans, etc., may be difficult. Further, physical movement by users during use may compound such difficulties.

Some current solutions to such problems involve instructing users not to change locations within the use environment, or to perform an action alerting the computing device of an upcoming input. However, such solutions may negatively impact the desired spontaneity and ease of use of a speech input environment.

SUMMARY

Accordingly, various embodiments are disclosed herein that relate to suppressing ambient sounds in speech received by a microphone array. For example, one embodiment provides a device comprising a microphone array, a processor, an analog-to-digital converter, and memory comprising instructions stored therein that are executable by the processor to suppress ambient sounds from speech inputs received by the microphone array. For example, the instructions are executable to receive a plurality of digital sound signals from the analog-to-digital converter, each digital sound signal based on an analog sound signal originating at the microphone array, and also to receive a multi-channel speaker signal. The instructions are further executable to generate a monophonic approximation signal of each multi-channel speaker signal, and to apply a linear acoustic echo canceller to each digital sound signal using the approximation signal. The instructions are further executable to generate a combined directionally-adaptive sound signal from a combination of the plurality of digital sound signals by a combination of time-invariant and adaptive beamforming techniques, and to apply one or more nonlinear noise suppression techniques to suppress a second ambient sound portion of the combined directionally-adaptive sound signal.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
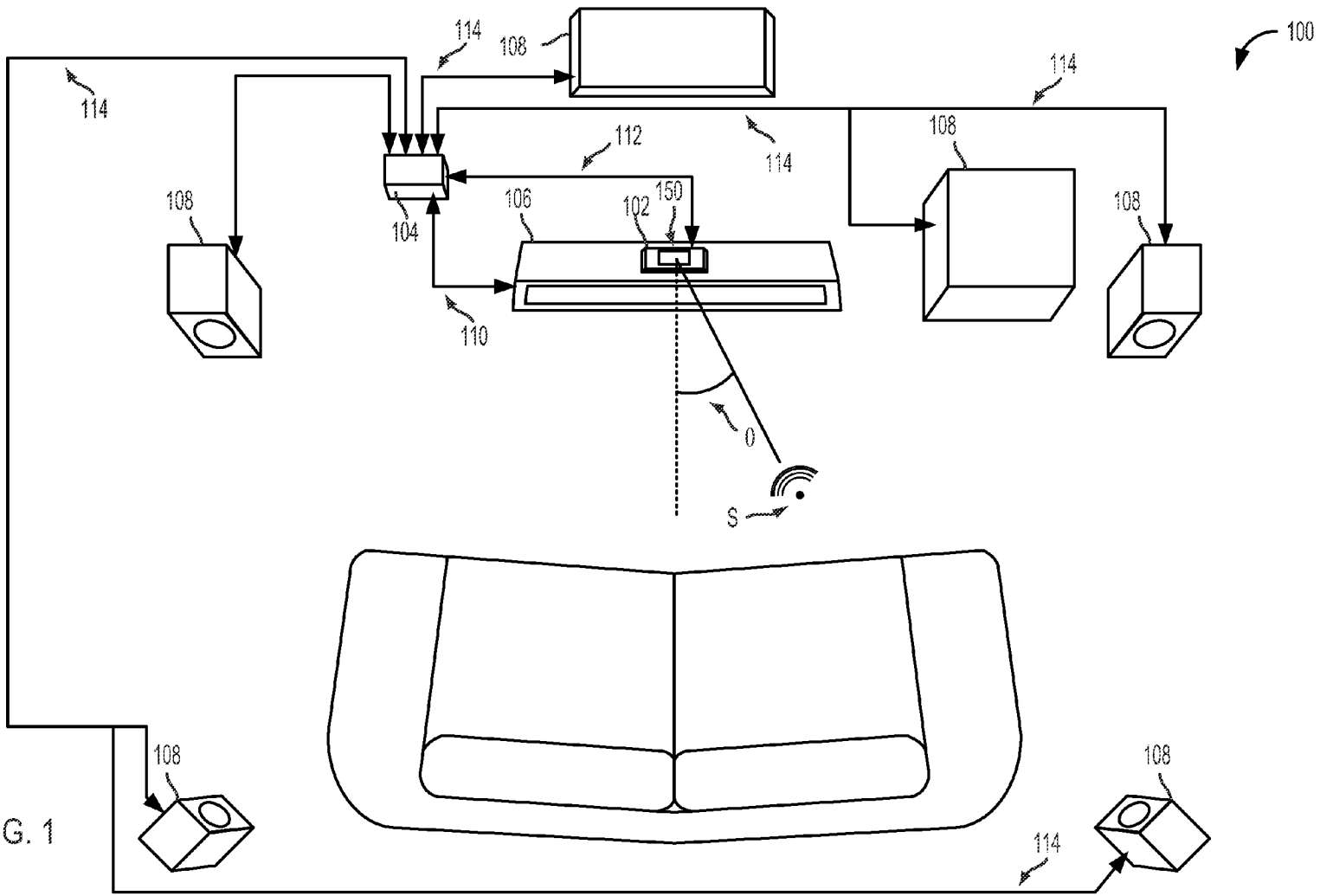
FIG. 1 is a schematic view of an embodiment of an operating environment for an embodiment of an audio input device.

FIG. 1 is a schematic view of an embodiment of an operating environment 100 for an embodiment of an audio input device 102 for suppressing ambient sounds from speech inputs received from a speech source S via a microphone array, schematically represented in FIG. 1 by box 150, of audio input device 102. For example, operating environment 100 may represent a home theater setting, a video game play space, etc. It will be appreciated that operating environment 100 is an exemplary operating environment; sizes, configurations, and arrangements of different constituents of operating environment 100 are depicted for illustrative purposes alone. Other suitable operating environments may be employed with audio input device 102.

In addition to audio input device 102, operating environment 100 may include a remote computing device 104. In some embodiments, the remote computing device may comprise a game console, while in other embodiments, the remote computing device may comprise any other suitable computing device. For example, in one scenario, remote computing device 104 may be a remote server operating in a network environment, a mobile device such as a mobile phone, a laptop or other personal computing device, etc.

Remote computing device 104 is connected to audio input device 102 by one or more connections 112. It will be appreciated that the various connections shown in FIG. 1 may be suitable physical connections in some embodiments or suitable wireless connections in some other embodiments, or a suitable combination thereof. Further, operating environment 100 may include a display 106 connected to remote computing device 104 by a suitable display connection 110.

Operating environment 100 further includes one or more speakers 108 connected to remote computing device 104 by suitable speaker connections 114, through which a speaker signal may be passed. In some embodiments, speakers 108 may be configured to provide multi-channel sound. For example, operating environment 100 may be configured for 5.1 channel surround sound, and may include a left channel speaker, a right channel speaker, a center channel speaker, a low-frequency effects speaker, a left channel surround speaker, and a right channel surround speaker (each of which is indicated by reference number 108). Thus, in the example embodiment, six audio channels may be passed in the 5.1 channel surround sound speaker signal.

Figure 2:
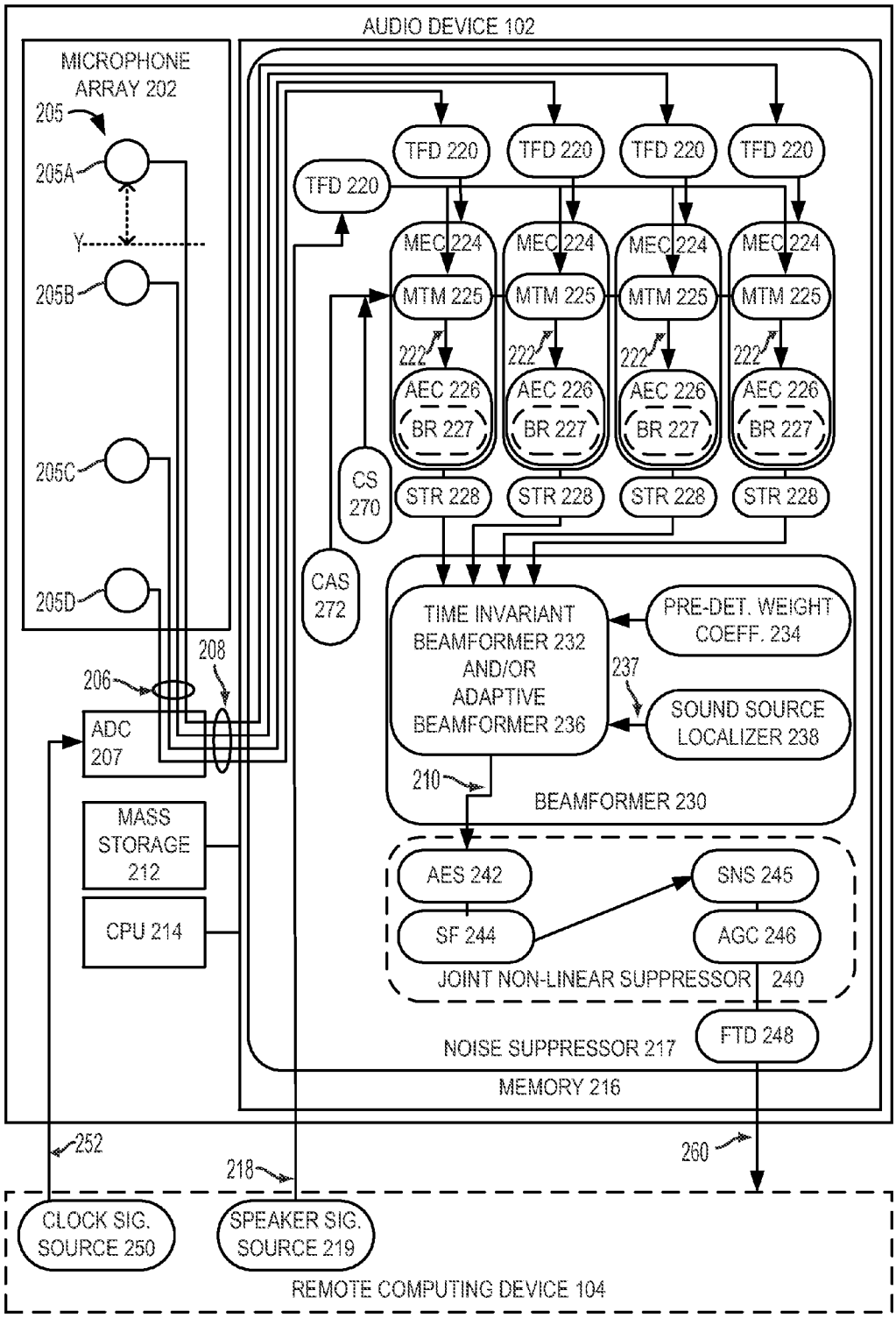
FIG. 2 is a schematic view of an embodiment of an audio input device.

FIG. 2 shows a schematic view of an embodiment of audio input device 102. Audio input device 102 includes a microphone array comprising a plurality of microphones 205 for converting sounds, such as speech inputs, into analog sound signals 206 for processing at audio input device 102. The analog sound signals from each microphone are directed to an analog-to-digital converter (ADC) 207, where each analog sound signal is converted to a digital sound signal. Audio input device 102 is further configured to receive a clock signal 252 from a clock signal source 250, an example of which is described in further detail below. Clock signal 252 may be used to synchronize analog sound signals 206 for conversion to a plurality of digital sound signals 208 at an analog-to-digital converter 207. For example, in some embodiments, clock signal 252 may be a speaker output clock signal synchronized to a microphone input clock.

Audio input device 102 further includes mass storage 212, a processor 214, memory 216, and an embodiment of a noise suppressor 217, which may be stored in mass storage 212 and loaded into memory 216 for execution by processor 214.

As described in more detail below, noise suppressor 217 applies noise suppression techniques in three phases. In a first phase, noise suppressor 217 is configured to suppress a portion of ambient noise in each digital sound signal 208 with one or more linear noise suppression techniques. Such linear noise suppression techniques may be configured to suppress ambient noise from fixed sources, and/or other ambient noise exhibiting little dynamic activity. For example, the first, linear suppression phase of noise suppressor 217 may suppress motor noises from stationary sources like a cooling fan of the gaming console, and may suppress speaker noises from stationary speakers. As such, audio input device 102 may be configured to receive a multi-channel speaker signal 218 from a speaker signal source 219 (e.g., a speaker signal output by remote computing device 104) to help with the suppression of such noise.

In a second phase, noise suppressor 217 is configured to combine the plurality of digital sound signals into a single combined directionally-adaptive sound signal 210 from each digital sound signal 208 that contains information regarding a direction from which received speech originates.

In a third phase, noise suppressor 217 is configured to suppress ambient noise in the combined directionally-adaptive sound signal 210 with one or more nonlinear noise suppression techniques that apply a greater amount of noise suppression to noise originating farther away from the direction from which received speech originates than from noise originating closer to such direction. Such nonlinear noise suppression techniques may be configured, for example, to suppress ambient noise exhibiting greater dynamic activity.

After performing noise suppression, audio input device 102 is configured to output a resulting sound signal 260 that may then be used to identify speech inputs in the received speech signal. In some embodiments, resulting sound signal 260 may be used for speech recognition. While FIG. 2 shows the output being provided to the remote computing device 104, it will be understood that the output may be provided to a local speech recognition system, or to a speech recognition system at any other suitable location. Additionally or alternatively, in some embodiments, resulting sound signal 260 may be utilized in a telecommunications application.

Performing linear noise suppression techniques before performing non-linear techniques may offer various advantages. For example, performing linear noise reduction to remove noise from fixed and/or predictable sources (e.g., fans, speaker sounds, etc.) may be performed with a relatively low likelihood of suppressing an intended speech input and also may reduce the dynamic range of the digital sound signals sufficiently to allow a bit depth of the digital audio signal to be reduced for more efficient downstream processing. Such bit depth reduction is described in more detail below. In some embodiments, the application of linear noise suppression techniques occurs near the beginning of the noise suppression process. Applicants recognized that this approach may reduce a volume of downstream nonlinear suppression signal processing, which may speed downstream signal processing.

Microphone array 202 may have any suitable configuration. For example, in some embodiments, microphones 205 may be arranged along a common axis. In such an arrangement, microphones 205 may be evenly spaced from one another in microphone array 202, or may be unevenly spaced from one another in microphone array 202. Using an uneven spacing may help to avoid a frequency null occurring at a single frequency at all microphones 205 due to destructive interference. In one specific embodiment, microphone array 202 may be configured according to dimensions set out in Table 1. It will be appreciated that other suitable arrangements may be employed.

TABLE 1

| | Distance Between Microphone and Centerline 'Y' of Array | | | | |
|---|---|---|---|---|---|
| | Overall | 205A – Y | 205B – Y | 205C – Y | 205D – Y |
| Length (m) | 0.225 | −0.1125 | 0.0305 | 0.0755 | 0.1125 |

Analog-to-digital converter 207 may be configured to convert each analog sound signal 206 generated by each microphone 205 to a corresponding digital sound signal 208, wherein each digital sound signal 208 from each microphone 205 has a first, higher bit depth. For example, analog-to-digital converter 207 may be a 24-bit analog-to-digital converter to support sound environments exhibiting a large dynamic range. The use of such a bit depth may help to reduce digital clipping of each analog sound signal 206 relative to the use of a lower bit depth. Further, as described in more detail below, the 24-bit digital sound signal output by the analog-to-digital converter may be converted to a lower bit depth at an intermediate stage in the noise suppression process to help increase downstream processing efficiency. In one specific embodiment, each digital sound signal 208 output by analog-to-digital converter 207 is a single-channel, 16 kHz, 24-bit digital sound signal.

In some embodiments, analog-to-digital converter 207 is configured to synchronize each digital sound signal 208 to a speaker signal 218 via a clock signal 252 received from a remote computing device 104. For example, a USB start-of-frame packet signal generated by a clock signal source 250 of remote computing device 104 may be used to synchronize analog-to-digital converter 207 for synchronizing sounds received at each microphone 205 with speaker signal 218. Speaker signal 218 is configured to include digital speaker sound signals for the generation of speaker sounds at speakers 108. Synchronization of speaker signal 218 with digital sound signal 208 may provide a temporal reference for subsequent noise suppression of a portion of the speaker sounds received at each microphone 205.

The output from the analog-to-digital converter 207 is received at the first phase noise suppressor 217, in which the noise suppressor removes a first portion of ambient noise. In the depicted embodiment, each digital sound signal 208 is converted to a frequency domain by a transformation at time-to-frequency domain transformation (TFD) module 220. For example, a transformation algorithm such as a Fourier transformation, a Modulated Complex Lapped Transformation, a fast Fourier transformation, or any other suitable transformation algorithm, may be used to convert each digital sound signal 208 to a frequency domain.

Digital sound signals 208 converted to a frequency domain at module 220 are output to a multi-channel echo canceller (MEC) 224. Multi-channel echo canceller 224 is configured to receive a multi-channel speaker signal 218 from a speaker signal source 219. In some embodiments, speaker signal 218 is also passed to fast Fourier transform module 220 for transforming speaker signal 218 to a speaker signal having a frequency domain, and then output to multi-channel echo canceller 224.

Each multi-channel echo canceller 224 includes a multi-channel to mono (MTM) transfer module 225 and a linear acoustic echo canceller (AEC) 226. Each mono transfer module 225 is configured to generate a monophonic approximation signal 222 of the multi-channel speaker signal 218 that approximates speaker sounds as received by the corresponding microphone 205. A predetermined calibration signal (CS) 270 may be used to help generate the monophonic approximation. Calibration signal 270 may be determined, for example, by emitting a known calibration audio signal (CAS) 272 from the speakers, receiving the speaker output arising from calibration audio signal 272 via the microphone array, and then comparing the received signal output to the signal as received by the speakers. The calibration signal may be determined intermittently, for example, at system set-up or start-up, or may be performed more often. In some embodiments, calibration audio signal 272 may be configured as any suitable audio signal that does not correlate among the speakers and covers a predetermined frequency spectrum. For example, in some embodiments, a sweeping sine signal may be employed. In some other embodiments, musical tone signals may be employed.

Each monophonic approximation signal 222 is passed from the corresponding multi-channel to mono transfer module 225 to a corresponding linear acoustic echo canceller 226. Each linear acoustic echo canceller 226 is configured to suppress a first ambient sound portion of each digital sound signal 208 based at least in part on monophonic approximation signal 222. For example, in one scenario, each linear acoustic echo canceller 226 may be configured to compare digital sound signal 208 with monophonic approximation signal 222 and further configured to subtract monophonic approximation signal 222 from the corresponding digital sound signal 208.

As mentioned above, in some embodiments, each multi-channel echo canceller 224 may be configured to convert each digital sound signal 208 to a digital sound signal 208 having a second, lower bit depth after applying linear acoustical echo canceller 226 to each digital sound signal 208 at a bit depth reduction (BR) module 227. For example, in some embodiments, at least a portion of multi-channel speaker signal 218 may be removed from digital sound signal 208, resulting in a bit depth reduced sound signal. Such bit depth reduction may help to speed downstream computational processing by allowing a dynamic range of the bit depth reduced sound signal to occupy a smaller bit depth. The bit depth may be reduced by any suitable degree and at any suitable processing point. For example, in the depicted embodiment, a 24-bit digital sound signal may be converted to a 16-bit digital sound signal after application of linear acoustic echo canceller 226. In other embodiments, the bit depth may be reduced by another amount, and/or at another suitable point. Further, in some embodiments, the discarded bits may correspond to bits that previously contained portions of digital sound signal 208 corresponding to speaker sounds suppressed at linear acoustic echo canceller 226.

Continuing with FIG. 2, the depicted noise suppressor 217 is further configured to apply a linear stationary tone remover (STR) 228 to each digital sound signal 208. Linear stationary tone remover 228 is configured to remove background sounds emitted by sources at approximately constant tones. For example, fans, air conditioners, or other white noise sources may emit approximately constant tones that may be received at microphone array 202. In one scenario, a linear stationary tone remover 228 may be configured to build a model of the approximately constant tones detected in digital sound signal 208 and to apply a noise cancellation technique to remove the tones. In some embodiments, each linear stationary tone remover 228 may be applied to each digital sound signal 208 after application of each linear acoustic echo canceller 226 and before generation of a combined directionally-adaptive sound signal 210. In some other embodiments, the linear stationary tone remover may have any other suitable position within noise suppressor 217.

After application of such linear noise suppression processes as described above, the plurality of digital sound signals are provided to the second phase of noise suppressor 217, which includes beamformer 230. Beamformer 230 is configured to receive the output of each linear stationary tone remover 228, and to generate a single combined directionally-adaptive sound signal 210 from a combination of the plurality of digital sound signals. Beamformer 230 forms the directionally-adaptive sound signal 210 by utilizing the differences in time at which sounds were received at each of the four microphones in the array to determine a direction from which the sounds were received. The combined directionally-adaptive sound signal may be determined in any suitable manner. For example, in the depicted embodiment, the directionally-adaptive sound signal is determined based on a combination of time-invariant and adaptive beamforming techniques. The resulting combined signal may have a narrow directivity pattern, which may be steered in a direction of a speech source.

Beamformer 230 may comprise time invariant beamformer 232 and adaptive beamformer 236 for generating combined directionally-adaptive sound signal 210. Time invariant beamformer 232 is configured to apply a series of predetermined weighting coefficients 234 to each digital sound signal 208, each predetermined weighting coefficient 234 being calculated based at least in part on an isotropic ambient noise distribution within a predefined sound reception zone of microphone array 202.

In some embodiments, time invariant beamformer 232 may be configured to perform a linear combination of each digital sound signal 208. Each digital sound signal 208 may be weighted by one or more predetermined weighting coefficients 234, which may be stored in a look-up table. Predetermined weighting coefficients 234 may be computed in advance for a predefined sound reception zone of microphone array 202. For example, predetermined weighting coefficients 234 may be calculated at 10-degree intervals in a sound reception zone extending 50 degrees on either side of a centerline of microphone array 202.

Time invariant beamformer 232 may cooperate with adaptive beamformer 236. For example, the predetermined weighting coefficients 234 may assist with the operation of adaptive beamformer 236. In one scenario, time invariant beamformer 232 may provide a starting point for the operation of adaptive beamformer 236. In a second scenario, adaptive beamformer 236 may reference time invariant beamformer 232 at predetermined intervals. This has the potential benefit of reducing a number of computational cycles to converge on a position of speech source S. Adaptive beamformer 236 is configured to apply a sound source localizer 238 to determine a reception angle θ (see FIG. 1) of speech source S with respect to microphone array 202 and to track speech source S based at least in part on reception angle θ as speech source S moves in real time. Reception angle θ is passed to adaptive beamformer 236 as a reception angle message 237. Beamformer 230 outputs combined directionally-adaptive sound signal 210 for further downstream noise suppression. For example, combined directionally-adaptive sound signal 210 may comprise a digital sound signal having a main lobe of higher intensity oriented in a direction of speech source S and having one or more side lobes of lower intensity based on predetermined weighting coefficients 234 and reception angle θ.

In some embodiments, sound source localizer 238 may provide reception angles for multiple speech sources S. For example, a four-source sound source localizer may provide reception angles for up to four speech sources. For example, a game player who is speaking while moving within the game play space may be tracked by sound source localizer 238. In one scenario according to this example, images generated for display by the game console may be adjusted responsive to the tracked change in position of the player, such as having faces of characters displayed follow the movements of the player.

Beamformer 230 outputs directionally-adaptive sound signal 210 to the third phase of noise suppressor 217, in which the noise suppressor 217 is configured to apply one or more nonlinear noise suppression techniques to suppress a second ambient sound portion of combined directionally-adaptive sound signal 210 based at least in part on a directional characteristic of combined directionally-adaptive sound signal 210. One or more of a nonlinear acoustic echo suppressor (AES) 242, a nonlinear spatial filter (SF) 244, a stationary noise suppressor (SNS) 245, and an automatic gain controller (AGC) 246 may be used for performing the nonlinear noise suppression. It will be appreciated that various embodiments of audio input device 102 may apply the nonlinear noise suppression techniques in any suitable order.

Nonlinear acoustic echo suppressor 242 is configured to suppress a sound magnitude artifact of combined directionally-adaptive sound signal 210, wherein the nonlinear acoustic echo suppressor is applied by determining and applying an acoustic echo gain based at least in part on a direction of speech source S. In some embodiments, nonlinear acoustic echo suppressor 242 may be configured to remove a residual echo artifact from combined directionally-adaptive sound signal 210. Removal of the residual echo artifact may be accomplished by estimating a power transfer function between speakers 108 and microphones 205. For example, acoustic echo suppressor 242 may apply a time-dependent gain to different frequency bins associated with combined directionally-adaptive sound signal 210. In this example, a gain approaching zero may be applied to frequency bins having a greater amount of ambient sounds and/or speaker sounds, while a gain approaching unity may be applied to frequency bins having a lesser amount of ambient sounds and/or speaker sounds.

Nonlinear spatial filter 244 is configured to suppress a sound phase artifact of combined directionally-adaptive sound signal 210, wherein nonlinear spatial filter 244 is applied by determining and applying a spatial filter gain based at least in part on a direction of speech source S. In some embodiments, nonlinear spatial filter 244 may be configured to receive phase difference information associated with each digital sound signal 208 to estimate a direction of arrival for each of a plurality of frequency bins. Further, the estimated direction of arrival may be used to calculate the spatial filter gain for each frequency bin. For example, frequency bins having a direction of arrival different from the direction of speech source S may be assigned spatial filter gains approaching zero, while frequency bins having a direction of arrival similar to the direction of speech source S may be assigned spatial filter gains approaching unity.

Stationary noise suppressor 245 is configured to suppress remaining background noise, wherein stationary noise suppressor 245 is applied by determining and applying a suppression filter gain based at least in part on a statistical model of the remaining noise component. Further, the statistical noise model and a current signal magnitude may be used to calculate the suppression filter gain for each frequency bin. For example, frequency bins having a magnitude lower than the noise deviation may be assigned suppression filter gains that approach zero, while frequency bins having a magnitude much higher than the noise deviation may be assigned suppression filter gains approaching unity.

Automatic gain controller 246 is configured to adjust a volume gain of the combined directionally-adaptive sound signal 210, wherein automatic gain controller 246 is applied by determining and applying the volume gain based at least in part on a magnitude of speech source S. In some embodiments, automatic gain controller 246 may be configured to compensate for different volume levels of a sound. For example, in a scenario where a first game player speaks with a softer voice while a second game player speaks with a louder voice, automatic gain controller 246 may adjust the volume gain to reduce a volume difference between the two players. In some embodiments, a time constant associated with a change of automatic gain controller 246 may be on the order of 3-4 seconds.

In some embodiments of audio input device 102, a nonlinear joint suppressor 240 including a joint gain filter may be employed, the joint gain filter being calculated from a plurality of individual gain filters. For example, the individual gain filters may be gain filters calculated by nonlinear acoustic echo suppressor 242, nonlinear spatial filter 244, stationary noise suppressor 245, automatic gain controller 246, etc. It will be appreciated that the order in which the various nonlinear noise suppression techniques are discussed is an exemplary order, and that other suitable ordering may be employed in various embodiments of audio input device 102.

Having been processed by one or more nonlinear noise suppression techniques, combined directionally-adaptive sound signal 210 is transformed from a frequency domain to a time domain at frequency-to-time domain transform (FTD) module 248, outputting a resulting sound signal 260. Frequency domain to time domain transformation may occur by a suitable transformation algorithm. For example, a transformation algorithm such as an inverse Fourier transformation, an inverse Modulated Complex Lapped Transformation, or an inverse fast Fourier transformation may be employed. Resulting sound signal 260 may be used locally or may be output to a remote computing device, such as remote computing device 104. For example, in one scenario resulting sound signal 260 may comprise a sound signal corresponding to a human voice, and may be blended with a game sound track for output at speakers 108.

Figure 3A:
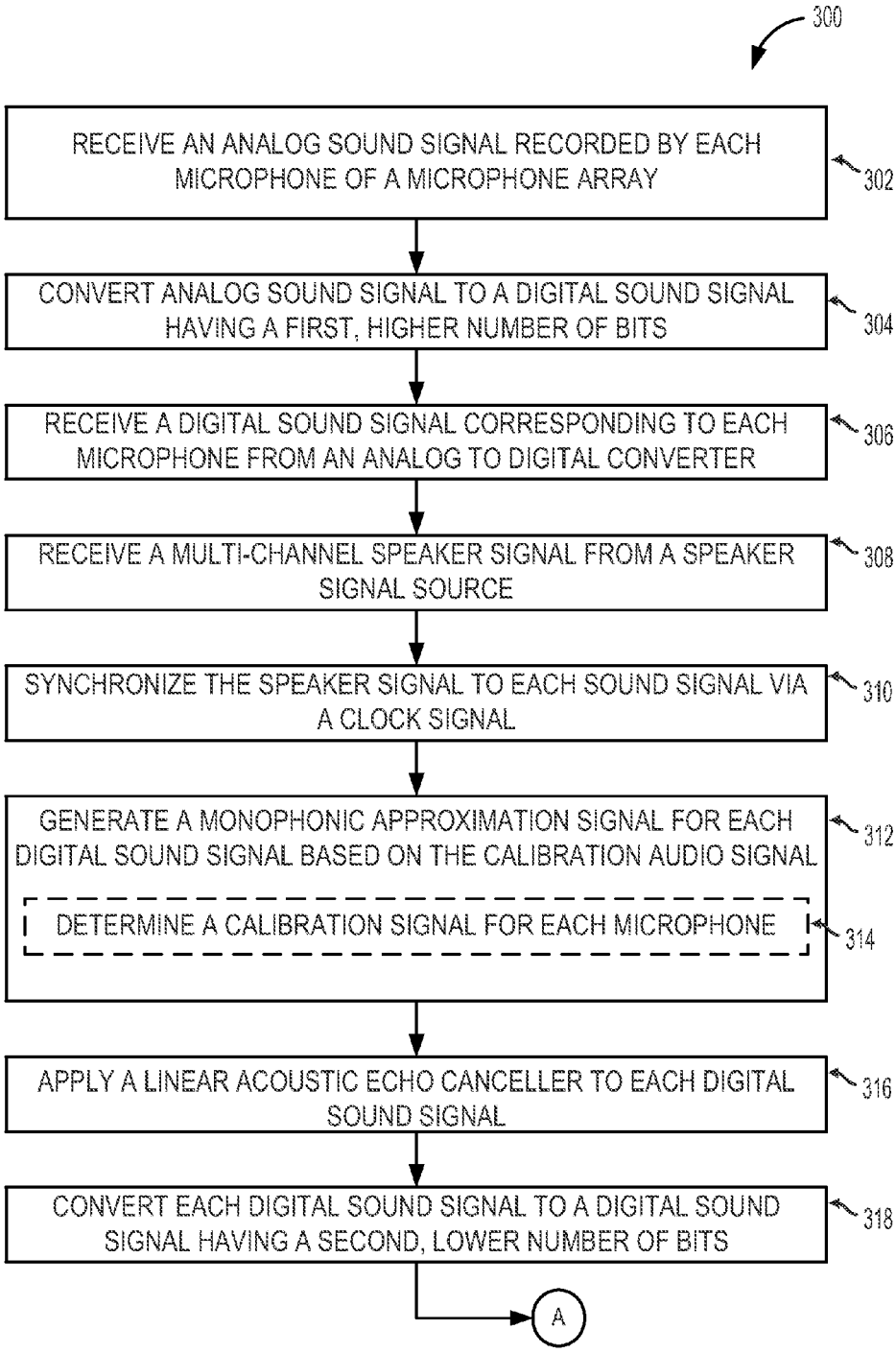
FIG. 3A is a flowchart of an embodiment of a method of operating the audio input device of FIG. 2.
Figure 3B:
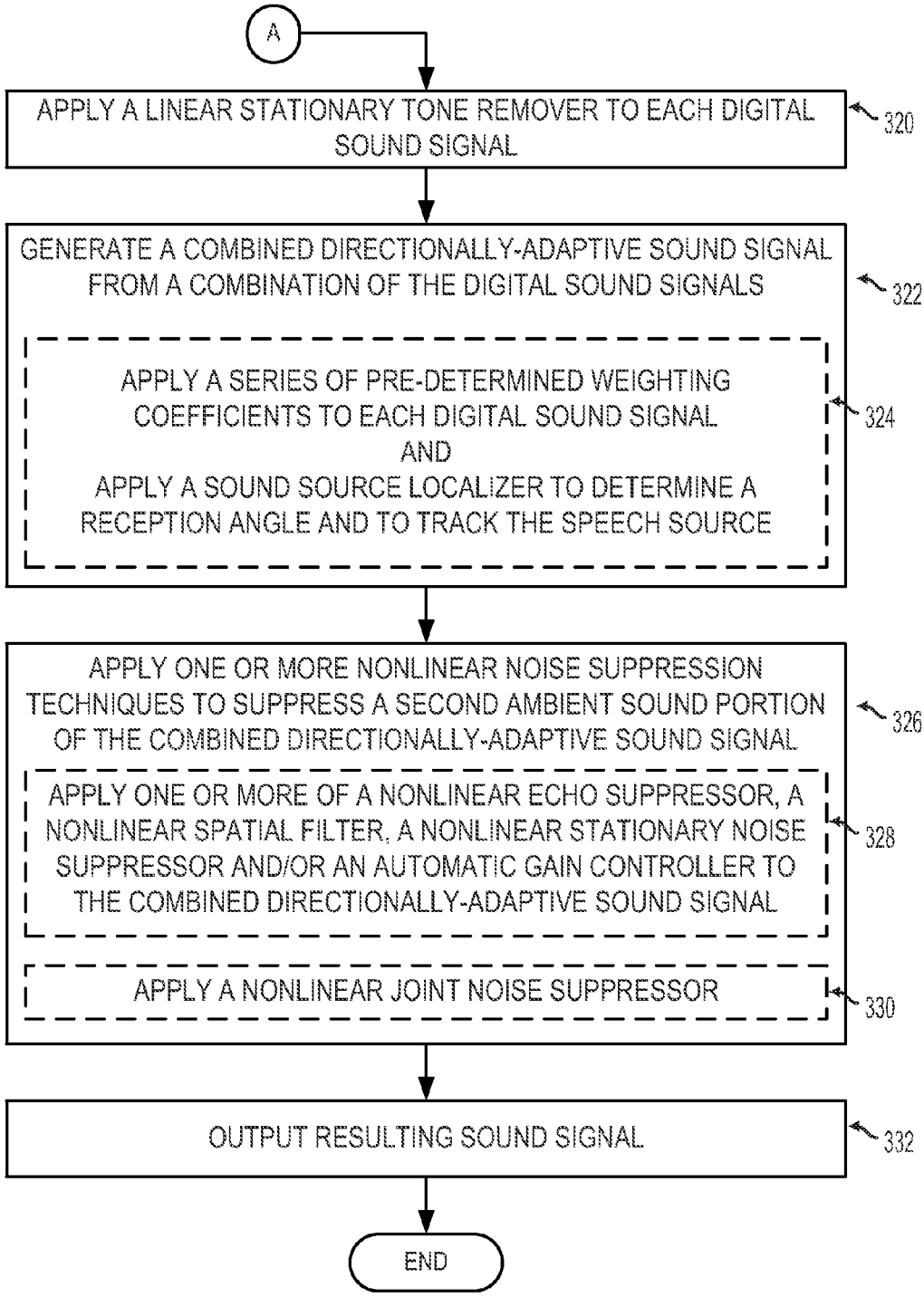
FIG. 3B is a continuation of the flowchart of FIG. 3A.

FIGS. 3A and 3B illustrate an embodiment of a method 300 for suppressing ambient sounds from speech received by a microphone array. Method 300 may be implemented using the hardware and software components described above in relation to FIGS. 1 and 2, or via other suitable hardware and software components. Method 300 comprises, at step 302, receiving an analog sound signal generated at each microphone of a microphone array comprising a plurality of microphones, each analog sound signal being received at least in part from a speech source. Continuing, method 300 includes, at step 304, converting each analog sound signal to a corresponding first digital sound signal having a first, higher bit depth at an analog-to-digital converter. At step 306, method 300 includes receiving a multi-channel speaker signal for a plurality of speakers from a speaker signal source.

Continuing, method 300 includes, at step 308, receiving a multi-channel speaker signal from a speaker signal source. At step 310, method 300 includes synchronizing the multi-channel speaker signal to each first digital sound signal via a clock signal received from a remote computing device. At step 312, method 300 includes generating a monophonic approximation signal of the multi-channel speaker signal for each first digital sound signal that approximates speaker sounds as received by the corresponding microphone. In some embodiments, step 312 includes, at 314, determining a calibration signal for each microphone by emitting a calibration audio signal from the speakers, detecting the calibration audio signal at each microphone, and generating the monophonic approximation signal based at least in part on the calibration signal for each microphone. It will be understood that step 314 may be performed intermittently, for example, upon system set-up or start-up, or may be performed more frequently where suitable.

Continuing, method 300 includes at step 316, applying a linear acoustic echo canceller to suppress a first ambient sound portion of each first digital sound signal based at least in part on the monophonic approximation signal. At step 318, method 300 includes converting each first digital sound signal to a second digital sound signal having a second, lower bit depth after applying the linear acoustical echo canceller to each digital sound signal. At step 320, method 300 includes applying a linear stationary tone remover to each second digital sound signal before generating the combined directionally-adaptive sound signal.

Continuing, at step 322, method 300 includes generating a combined directionally-adaptive sound signal from a combination of each second digital sound signal based at least in part on a combination of time-invariant and/or adaptive beamforming techniques for tracking the speech source. In some embodiments, step 322 includes, at step 324, applying a series of predetermined weighting coefficients to each sound signal, each predetermined weighting coefficient being calculated based at least in part on an isotropic ambient noise distribution within a predefined sound reception zone of the microphone array and applying a sound source localizer to determine a reception angle of the speech source with respect to the microphone array and to track the speech source based at least in part on the reception angle as the speech source moves in real time.

Continuing, method 300 includes, at step 326 applying one or more nonlinear noise suppression techniques to suppress a second ambient sound portion of the combined directionally-adaptive sound signal based at least in part on a directional characteristic of the combined directionally-adaptive sound signal. In some embodiments, step 326 includes, at step 328, applying one or more of: a nonlinear acoustic echo suppressor for suppressing a sound magnitude artifact, wherein the nonlinear acoustic echo suppressor is applied by determining and applying an acoustic echo gain based on a direction of the speech source; a nonlinear spatial filter for suppressing a sound phase artifact, wherein the nonlinear spatial filter is applied by determining and applying a spatial filter gain based on a time characteristic of the speech source; a nonlinear stationary noise suppressor, wherein the stationary noise suppressor is applied by determining and applying a suppression filter gain based at least in part on a statistical model of a remaining noise component; and/or a automatic gain controller for adjusting a volume gain of the combined directionally-adaptive sound signal, wherein the automatic gain controller is applied by determining and applying the volume gain based at least in part on a relative volume of the speech source. In some embodiments, step 326 includes, at step 330, applying a nonlinear joint noise suppressor including a joint gain filter, the joint gain filter being calculated from a plurality of individual gain filters. Continuing, method 300 includes, at step 332, outputting a resulting sound signal.

It will be appreciated that the computing devices described herein may be any suitable computing device configured to execute the programs described herein. For example, the computing devices may be a mainframe computer, a personal computer, a laptop computer, a portable data assistant (PDA), a computer-enabled wireless telephone, a networked computing device, or any other suitable computing device. Further, it will be appreciated that the computing devices described herein may be connected to each other via computer networks, such as the Internet. Further still, it will be appreciated that the computing devices may be connected to a server computing device operating in a network cloud environment.

The computing devices described herein typically include a processor and associated volatile and non-volatile memory, and are typically configured to execute programs stored in non-volatile memory using portions of volatile memory and the processor. As used herein, the term "program" refers to software or firmware components that may be executed by, or utilized by, one or more of the computing devices described herein. Further, the term "program" is meant to encompass individual or groups of executable files, data files, libraries, drivers, scripts, database records, etc. It will be appreciated that computer-readable media may be provided having program instructions stored thereon, which cause the computing device to execute the methods described above and cause operation of the systems described above upon execution by a computing device.

It is to be understood that the configurations and/or approaches described herein are exemplary in nature, and that these specific embodiments or examples are not to be considered in a limiting sense, because numerous variations are possible. The specific routines or methods described herein may represent one or more of any number of processing strategies. As such, various acts illustrated may be performed in the sequence illustrated, in other sequences, in parallel, or in some cases omitted. Likewise, the order of the above-described processes may be changed.

The subject matter of the present disclosure includes all novel and nonobvious combinations and subcombinations of the various processes, systems and configurations, and other features, functions, acts, and/or properties disclosed herein, as well as any and all equivalents thereof.

What is claimed is:

1. A computing device configured to receive speech inputs, the computing device comprising:

a microphone array having a plurality of microphones;

a processor in operative communication with the microphone array;

an analog-to-digital converter in operative communication with the microphone array and with the processor; and memory comprising instructions stored therein that are executable by the processor to:

receive a plurality of digital sound signals from the analog-to-digital converter, each digital sound signal being based on an analog sound signal originating at the microphone array, receive a multi-channel speaker signal from a speaker signal source, for each digital sound signal, generate a monophonic approximation signal of the multi-channel speaker signal that approximates speaker sounds as received by the corresponding microphone, apply a linear acoustic echo canceller to suppress a first ambient sound portion of each digital sound signal based at least in part on the monophonic approximation signal, generate a combined directionally-adaptive sound signal from a combination of each digital sound signal based at least in part on a combination of time-invariant and adaptive beamforming techniques, and apply one or more nonlinear noise suppression techniques to suppress a second ambient sound portion of the combined directionally-adaptive sound signal based at least in part on a directional characteristic of the combined directionally-adaptive sound signal.

2. The device of claim 1, wherein the instructions are further executable by the processor to apply a linear stationary tone remover to each digital sound signal before generating the combined directionally-adaptive sound signal.

3. The device of claim 1, wherein the suppression of the second ambient sound portion occurs by applying one or more of a nonlinear acoustic echo suppressor for suppressing a sound magnitude artifact, wherein the nonlinear acoustic echo suppressor is applied by determining and applying an acoustic echo gain based at least in part on a direction of a speech source, a nonlinear spatial filter for suppressing a sound phase artifact, wherein the nonlinear spatial filter is applied by determining and applying a spatial filter gain based at least in part on a direction of the speech source, a nonlinear stationary noise suppressor, wherein the stationary noise suppressor is applied by determining and applying a suppression filter gain based at least in part on a statistical model of a remaining noise component, and/or an automatic gain controller for adjusting a volume gain of the combined directionally-adaptive sound signal, wherein the automatic gain controller is applied by determining and applying the volume gain based at least in part on a direction of the speech source.

4. The device of claim 1, wherein the suppression of the second ambient sound portion occurs by applying a nonlinear joint noise suppressor including a joint gain filter, the joint gain filter being calculated from a plurality of individual gain filters.

5. The device of claim 1, wherein the instructions are further executable by the processor to:

determine a calibration signal for each microphone by emitting a calibration audio signal from each of a plurality of speakers and detecting the calibration audio signal at each microphone, and to determine the monophonic approximation signal based at least in part on the calibration signal for each microphone.

6. The device of claim 1, wherein the analog-to-digital converter is configured to convert an analog sound signal generated by each microphone to a corresponding digital sound signal at the analog-to-digital converter, wherein each digital sound signal from each microphone has a first, higher bit depth, and wherein the instructions are further executable by the processor to convert each digital sound signal to a digital sound signal having a second, lower bit depth after applying the linear acoustical echo canceller to each digital sound signal.

7. The device of claim 1, wherein the analog-to-digital converter is configured to synchronize the multi-channel speaker signal to each digital sound signal via a clock signal received from a remote computing device.

8. The device of claim 1, wherein the microphones are unevenly spaced from one another in the microphone array.

9. The device of claim 1, wherein the combination of time-invariant and adaptive beamforming techniques for generating the combined directionally-adaptive sound signal includes instructions executable by the processor to:

apply a series of predetermined weighting coefficients to each digital sound signal, each predetermined weighting coefficient being calculated based at least in part on an isotropic ambient noise distribution within a predefined sound reception zone of the microphone array, and to apply a sound source localizer to determine a reception angle of a speech source with respect to the microphone array and to track the speech source based at least in part on the reception angle as the speech source moves in real time.

10. A method for suppressing ambient sounds from speech received by a microphone array, comprising, at memory including instructions stored therein that are executable by a processor:

receiving a plurality of digital sound signals from an analog-to-digital converter, each digital sound signal based on an analog sound signal originating at the microphone array;

receiving a multi-channel speaker signal from a speaker signal source;

generating a monophonic approximation signal of the multi-channel speaker signal for each digital sound signal that approximates speaker sounds as received by the corresponding microphone;

applying a linear acoustic echo canceller to suppress a first ambient sound portion of each digital sound signal based at least in part on the monophonic approximation signal;

generating a combined directionally-adaptive sound signal from a combination of each digital sound signal based at least in part on a combination of time-invariant and adaptive beamforming techniques for tracking a speech source;

applying one or more nonlinear noise suppression techniques to suppress a second ambient sound portion of the combined directionally-adaptive sound signal based at least in part on a directional characteristic of the combined directionally-adaptive sound signal; and outputting a resulting sound signal.

11. The method of claim 10, wherein generating a monophonic approximation signal of the multi-channel speaker signal for each digital sound signal that approximates speaker sounds as received by the corresponding microphone further comprises:

determining a calibration signal for each microphone by emitting a calibration audio signal from each of a plurality of speakers;

detecting the calibration audio signal at each microphone; and generating the monophonic approximation signal based at least in part on the calibration signal for each microphone.

12. The method of claim 10, further comprising applying a linear stationary tone remover to each digital sound signal before generating the combined directionally-adaptive sound signal.

13. The method of claim 10, wherein applying one or more nonlinear noise suppression techniques to suppress a second ambient sound portion of the combined directionally-adaptive sound signal based in part on a directional characteristic of the combined directionally-adaptive sound signal further comprises applying one or more of a nonlinear acoustic echo suppressor for suppressing a sound magnitude artifact, wherein the nonlinear acoustic echo suppressor is applied by determining and applying an acoustic echo gain based on a direction of the speech source, a nonlinear spatial filter for suppressing a sound phase artifact, wherein the nonlinear spatial filter is applied by determining and applying a spatial filter gain based on a time characteristic of the speech source, a nonlinear stationary noise suppressor, wherein the stationary noise suppressor is applied by determining and applying a suppression filter gain based at least in part on a statistical model of a remaining noise component, and/or an automatic gain controller for adjusting a volume gain of the combined directionally-adaptive sound signal, wherein the automatic gain controller is applied by determining and applying the volume gain based at least in part on a relative volume of the speech source.

14. The method of claim 10, wherein applying one or more nonlinear noise suppression techniques to suppress a second ambient sound portion of the combined directionally-adaptive sound signal based at least in part on a magnitude and/or a time characteristic of the combined directionally-adaptive sound signal further comprises applying a nonlinear joint noise suppressor including a joint gain filter, the joint gain filter being calculated from a plurality of individual gain filters.

15. The method of claim 10, further comprising:

converting an analog sound signal generated by each microphone to a corresponding digital sound signal at the analog-to-digital converter, wherein each digital sound signal from each microphone has a first, higher bit depth; and converting each digital sound signal to a digital sound signal having a second, lower bit depth after applying the linear acoustical echo canceller to each digital sound signal.

16. The method of claim 10, further comprising synchronizing the multi-channel speaker signal to each digital sound signal via a clock signal received from a remote computing device.

17. The method of claim 10, wherein generating a combined directionally-adaptive sound signal from a combination of each digital sound signal based at least in part on a combination of time-invariant and adaptive beamforming techniques for tracking the speech source further comprises:

applying a series of predetermined weighting coefficients to each digital sound signal, each predetermined weighting coefficient being calculated based at least in part on an isotropic ambient noise distribution within a predefined sound reception zone of the microphone array, and applying a sound source localizer to determine a reception angle of the speech source with respect to the microphone array and to track the speech source based at least in part on the reception angle as the speech source moves in real time.

18. A method for suppressing ambient sounds from speech received by a microphone array, at memory including instructions stored therein that are executable by a processor:

receiving an analog sound signal generated at each microphone of a microphone array comprising a plurality of microphones, each analog sound signal being separately received at least in part from a speech source;

converting each analog sound signal to a corresponding first digital sound signal having a first, higher bit depth at an analog-to-digital converter;

receiving a multi-channel speaker signal for a plurality of speakers from a speaker signal source;

synchronizing the multi-channel speaker signal to each first digital sound signal via a clock signal received from a remote computing device;

determining a calibration signal for each microphone by emitting a calibration audio signal from each of the plurality of speakers;

detecting the calibration audio signal at each microphone of the microphone array;

generating a monophonic approximation signal of the multi-channel speaker signal for each first digital sound signal that approximates speaker sounds as received by the corresponding microphone based at least in part on the calibration signal for each microphone;

applying a linear acoustic echo canceller to suppress a first ambient sound portion of each first digital sound signal based at least in part on the monophonic approximation signal;

converting each first digital sound signal to a second digital sound signal having a second, lower bit depth after applying the linear acoustic echo canceller to each digital sound signal;

applying a linear stationary tone remover to each second digital sound signal;

generating a combined directionally-adaptive sound signal from a combination of each second digital sound signal by applying a series of predetermined weighting coefficients to each second digital sound signal, each predetermined weighting coefficient being calculated based at least in part on an isotropic ambient noise distribution within a predefined sound reception zone of the microphone array, and by applying a sound source localizer to determine a reception angle of the speech source with respect to the microphone array and to track the speech source based at least in part on the reception angle as the speech source moves in real time;

applying one or more nonlinear noise suppression techniques to suppress a second ambient sound portion of the combined directionally-adaptive sound signal based at least in part on a directional characteristic of the combined directionally-adaptive sound signal; and outputting a resulting sound signal.

19. The method of claim 18, wherein applying one or more nonlinear noise suppression techniques to suppress a second ambient sound portion of the combined directionally-adaptive sound signal based in part on a magnitude and/or a time characteristic of the combined directionally-adaptive sound signal further comprises suppressing the second ambient sound portion of each digital sound signal by applying one or more of:

a nonlinear acoustic echo suppressor for suppressing a sound magnitude artifact, wherein the nonlinear acoustic echo suppressor is applied by determining and applying an acoustic echo gain based on a direction of the speech source, a nonlinear spatial filter for suppressing a sound phase artifact, wherein the nonlinear spatial filter is applied by determining and applying a spatial filter gain based at least in part on a direction of the speech source, a nonlinear stationary noise suppressor wherein the stationary noise suppressor is applied by determining and applying a suppression filter gain based at least in part on a statistical model of a remaining noise component, and/or a automatic gain controller for adjusting a volume gain of the combined directionally-adaptive sound signal, wherein the automatic gain controller is applied by determining and applying the volume gain based at least in part on a direction of the speech source.

20. The method of claim 18, wherein applying one or more nonlinear noise suppression techniques to suppress a second audio sound portion of the combined directionally-adaptive sound signal based at least in part on a magnitude and/or a time characteristic of the combined directionally-adaptive sound signal further comprises applying a nonlinear joint noise suppressor including a joint gain filter, the joint gain filter being calculated from a plurality of individual gain filters.

* * * * *